US005745129A

United States Patent [19]

Moriyama et al.

[11] Patent Number: 5,745,129

[45] Date of Patent: Apr. 28, 1998

[54] INK JET HEAD, INK JET APPARATUS AND DRIVING METHOD THEREFOR

[75] Inventors: Jiro Moriyama; Yutaka Koizumi, both of Yokohama; Toshiaki Hirosawa, Hiratsuka, all of Japan

[73] Assignee: Canon Kabushiki Kaisha, Tokyo, Japan

[21] Appl. No.: 527,509

[22] Filed: Sep. 13, 1995

Related U.S. Application Data

[63] Continuation of Ser. No. 67,581, May 26, 1993, abandoned.

[30] Foreign Application Priority Data

Jun. 1, 1992 [JP] Japan ..... 4-140678

[51] Int. Cl.[6] ..... B41J 2/055

[52] U.S. Cl. ..... 347/12; 347/65; 347/94

[58] Field of Search ..... 347/12, 13, 42, 347/47, 56, 61, 65, 68, 94

[56] References Cited

U.S. PATENT DOCUMENTS

| | | | |
|---|---|---|---|
| 4,104,646 | 8/1978 | Fischbeck | 347/11 |
| 4,313,124 | 1/1982 | Hara | 347/57 |
| 4,345,262 | 8/1982 | Shirato et al. | 347/10 |
| 4,459,600 | 7/1984 | Sato et al. | 347/47 |
| 4,463,359 | 7/1984 | Ayata et al. | 347/56 |
| 4,558,333 | 12/1985 | Sugitani et al. | 347/65 |
| 4,578,687 | 3/1986 | Cloutier et al. | 347/44 |
| 4,630,072 | 12/1986 | Scardovi et al. | 347/94 |
| 4,723,129 | 2/1988 | Endo et al. | 347/56 |
| 4,740,796 | 4/1988 | Endo et al. | 347/56 |
| 4,894,667 | 1/1990 | Moriyama | 347/68 |
| 4,901,092 | 2/1990 | Moriyama | 347/68 |
| 5,173,717 | 12/1992 | Kishida et al. | 347/13 |

FOREIGN PATENT DOCUMENTS

| | | | |
|---|---|---|---|
| 59-123670 | 7/1984 | Japan . | |
| 59-179357 | 10/1984 | Japan | 347/94 |
| 61-37438 | 2/1986 | Japan | 347/65 |
| 1285356 | 11/1989 | Japan . | |
| 2-283453 | 11/1990 | Japan | 347/65 |
| 3-227632 | 10/1991 | Japan | 347/13 |
| 3-246043 | 11/1991 | Japan | 347/13 |
| 3-247455 | 11/1991 | Japan | 347/13 |
| 5-31907 | 2/1993 | Japan | 347/94 |

*Primary Examiner*—John E. Barlow, Jr.

*Attorney, Agent, or Firm*—Fitzpatrick, Cella, Harper & Scinto

[57] ABSTRACT

An ink jet head has plural liquid ink paths, each having a discharge opening for discharging ink when energy is applied to ink in a corresponding ink path, and a common ink chamber communicating with an end of each ink path for supplying ink to the discharge openings. The discharge openings are disposed in plural groups, which are consecutively driven by simultaneously applying energy to ink paths corresponding to selected discharge openings in a given group. The ends of the ink paths are disposed in the common ink chamber in groups consecutively arranged in accordance with the driving order of the discharge opening groups, and each ink path includes a portion proximate to that end which is directed away from the next consecutively arranged ink path group. This arrangement suppresses pressure interference between the consecutively driven discharge opening groups and enables high-quality, high-speed recording in a compact recording head.

15 Claims, 7 Drawing Sheets

INK JET HEAD, INK JET APPARATUS AND DRIVING METHOD THEREFOR

This application is a continuation of application Ser. No. 08/067,581 filed May 26, 1993, now abandoned.

BACKGROUND OF THE INVENTION

1. Field of the Invention

The present invention relates to a liquid jet head, a liquid jet apparatus and a driving method for a liquid jet head, and more particularly to an ink jet recording head, an ink jet recording apparatus and a driving method for an ink jet recording head. In ink jet recording, recording is carried out by discharging ink from an ink jet recording head onto a recording medium.

2. Background Information on the Invention

A recording apparatus records images (the term "images" herein includes characters) according to image information (the term "image information" herein includes character information or the like) on a recording medium such as paper, a thin plastic film, textiles or any other medium capable of having an image recorded thereon. Such a recording apparatus can function as a printing machine, a copying machine, a facsimile machine and so on, or as an output terminal of a composite electronic machine, such as a work station or the like, functioning as a computer, a word processor and so on. Such a recording apparatus can be characterized by its recording method as an ink jet apparatus, a wire dot apparatus, a thermal printing apparatus, a laser beam apparatus and so on.

In a serial-type recording apparatus using a serial scanning method, in which main scanning is carried out in a main scan direction transverse to a sub-scan direction of conveyance of a recording medium, the recording of images is carried out by a recording means carried on a carriage which moves in the main scan direction along a recording medium after the recording medium is positioned at a predetermined recording region. After recording of one line is finished, a predetermined amount of conveyance of the recording medium in the sub-scan direction is carried out. Then recording of the next line on the stationary recording member is carried out. The main scanning and the sub-scanning are repeated alternately. In this way, recording on the whole recording medium is carried out.

On the other hand, in a line-type recording apparatus, in which the only movement is the sub-scanning of a recording medium, recording of one line is carried out at almost the same time the recording medium is positioned at a predetermined recording region. Then a predetermined amount of conveyance of the recording medium (a pitch of one line) is carried out and recording of the next line is carried out at almost the same time. The one-line recording and the sub-scanning are repeated alternately. In this way, recording of the whole recording medium is carried out.

Among the foregoing recording apparatuses, an ink jet recording apparatus carries out recording by discharging ink from a recording head onto a recording medium. An ink jet recording apparatus has many advantages. It is relatively easy to make the recording means compact. Images with a high density can be recorded rapidly. Recording on plain paper can be carried out without special treatment of the paper. The running cost is relatively low. Recording can be carried out quietly because it uses a non-impact method. In addition, it is easy to carry out color recording by using plural color inks. Especially, an ink jet recording apparatus with a full-line type of recording head which has plural discharge openings extending over the width of a recording area of a recording medium can carry out recording rapidly.

Particularly, an ink jet recording head utilizing thermal energy to discharge ink can be made very compact. One of the reasons for the compact design resides in the manufacturing method used to make the head. That is, a typical ink jet recording head with a high density of liquid paths (or discharge openings) can be manufactured easily by providing members for forming walls of liquid paths, a top plate and so forth on a heater board member provided with electro-thermal converting bodies through semiconductor manufacturing processes such as etching, deposition, sputtering or the like.

FIG. 1A is a schematic cross sectional view showing an ink discharging portion of an ink jet recording head 201. And FIG. 1B is a schematic cross sectional view taken on line A—A of FIG. 1A. As illustrated in FIGS. 1A and 1B, a plurality (256 in this example) of discharge openings 208 are provided at a pitch of 63.5 microns in a substantially vertical direction on a surface of a recording head 201, which is positioned opposed to a recording medium such as recording paper (not shown in FIGS. 1A and 1B) at a certain distance (for example, about 0.5 to 2.0 mm) from the surface. The discharge openings 208 are designated No. 1 to No. 256. A heat generating portion 203 of an electro-thermal converting body on a silicon base plate member 211 for generating thermal energy utilized to discharge ink is provided on a wall of each ink path 206, which is defined by separation walls 202 and communicates between a common ink chamber 209 and each discharge opening 208. The silicon base plate member 211 is put on an aluminum base plate member 210 mainly to maintain the strength of the ink jet head 201. The ink jet recording head 201 is carried on a carriage (not shown in FIGS. 1A and 1B) so that the discharge openings 208 are disposed in a line transverse to the direction of the movement of the carriage (the main scanning direction). Ink is supplied from an ink storage (not shown in FIGS. 1A and 1B) to the common ink chamber 209 through an ink supply tube 204 and a filter 207, with holes smaller than the discharge openings, for eliminating extraneous matter in the ink. Ink is discharged as a droplet from a selected discharge opening 208 of the recording head 201 by driving the corresponding electro-thermal converting body according to a discharge signal provided from a driving circuit (not shown in FIGS. 1A and 1B) of the apparatus through a flexible cable 205 to generate a bubble by film boiling of the ink in the corresponding ink path 206.

This structure can lead to mutual interference between respective ink paths, which can affect the discharge characteristics of an ink droplet, because of the common ink chamber communicating with the plurality of ink paths. For example, the volume and/or the velocity of an ink droplet from a particular discharge opening can be affected if ink is discharged from that opening just after ink is discharged from an adjacent discharge opening, as compared to a case where ink is discharged from a discharge opening without ink previously being discharged from an adjacent opening or where sufficient time has elapsed after ink was discharged from the adjacent opening.

Under such conditions, the discharge characteristics of the ink droplet can deteriorate in that the volume and/or the velocity of the ink droplet can change more than an acceptable amount. The recording quality of recorded characters and recorded images therefore deteriorates due to the deterioration of the discharge characteristics of the ink droplets. A change in the volume of an ink droplet has an especially large influence on the recording quality. The more discharge openings ink from which ink is simultaneously discharged, the larger the deterioration of the discharge characteristics of a subsequent ink droplet from a different discharge opening. In addition, the shorter the distance from the rear edges of the separation walls for the plurality of ink paths to the rear wall of the common ink chamber, the larger the deterioration of the discharge characteristics of a subsequent ink droplet from a different discharge opening.

The reasons for the deterioration of the discharge characteristics will be explained in connection with FIGS. 2 and 3. FIG. 2 is a graph showing the timing of pulses supplied to energy generating bodies of the ink jet head. In FIG. 2, a pulse P1 is supplied at the time of t=0 to enable discharge of ink from a first discharge opening, and a pulse P2 is supplied at the time of t=ts to enable discharge of ink from the second discharge opening. The width of each pulse is 10 microseconds and the voltage of each pulse is 30 V.

FIG. 3 is a schematic partial sectional view showing a portion of the ink jet head illustrated in FIG. 1B.

Referring to FIG. 3, ink may be discharged simultaneously in accordance with the enabling pulse P1 from selected ones of the first discharge openings respectively communicated with ink paths Nos. 1 to 4. FIG. 3 shows transmission of pressure in ink in the ink passage of the ink jet head just before selected energy generating bodies respectively corresponding to the ink paths Nos. 5 to 8 are driven in accordance with the enabling pulse P2. Bubbles 221 are generated by supplying driving pulses to heat generating portions of electro-thermal converting bodies corresponding to the ink paths Nos. 1 to 4. This begins discharging ink from the corresponding discharge openings in the direction of arrows C at a timing determined by the pulse P1. Simultaneously a small amount of ink flows back into the common ink chamber 209 in the direction of arrows D. As a result, at the discharge openings 208 of the ink paths Nos. 5 and up, a small amount of ink protrudes in the direction of arrows E without being discharged. That is to say, the ink meniscus at each such opening becomes slightly convex. Subsequently, ink is discharged from the discharge openings of the ink paths Nos. 1 to 4 as usual.

If ink is discharged from say the discharge openings communicated with the ink paths Nos. 5 to 8 with the pulse P2 at the time of t=ts=13 micro-seconds, these discharges are carried out when the meniscuses at those openings remain convex. Therefore, the volume of an ink droplet from each of the discharge openings of the ink paths Nos. 5 to 8 is larger by ΔV than if the pulse P2 was supplied without the previous supply of the pulse P1. In other words, a larger ink droplet is discharged from those openings. It is generally known that the deterioration of recording quality can be recognized visually when the difference of the volumes of discharged ink droplets at adjacent locations on a recording medium approaches approximately 10%.

While it is difficult to measure precisely the increased volume of discharged ink droplets from the discharge opening communicated with the ink path No. 5, it can be estimated by an approximate calculation as follows. The height of the protrusion of the meniscus from the surface with the discharge opening communicated with the ink path No. 5 was 10 microns in the situation mentioned above. Though the actual shape of the ink path is a rectangular parallel-piped with a rectangular section of 20 microns×25 microns, it can be regarded as a cylinder with a circular section 25 microns in diameter. In addition, the protrusion of the meniscus 212 from the discharge opening communicated with the ink path No. 5 is regarded as a portion of a sphere as illustrated in FIG. 4 from observation with a microscope. FIG. 4 schematically depicts a circular discharge opening 208 having a diameter of 25 microns.

The increase ΔV1 of the protrusion of the meniscus 212 from the flat surface of the discharge opening is calculated to be ΔV1=2.98 picoliters (pl). The meniscus 212 is normally slightly concave, about two microns in depth from the surface of the discharge opening, in a steady state when ink is not being discharged. The difference ΔV2 in volume between the meniscus in this steady state and the flat surface with the discharge opening is calculated to be ΔV2=0.16 pl. From these values, the increase ΔV of the volume of a discharged ink droplet is calculated as ΔV=ΔV1+ΔV2=3.14 pl. The approximate volume V of a typical discharged ink droplet is V=28 pl. Therefore, the ratio ΔV/V, the difference of the volumes of discharged ink droplets, is ΔV/V=11.2%.

Consequently, the deterioration of recording quality can be recognized visually because ΔV/V exceeds 10%.

In the foregoing explanation, the shape of the meniscus 212 at the discharge opening communicated with the ink path No. 5 is changing constantly, and the pulse P2 is generally supplied when the meniscus 212 protrudes the most. It has been confirmed that the difference of the volumes of discharged ink droplets becomes even larger if the pulse P2 is supplied a little earlier. This is believed to be because there is a delay between the time the pulse is supplied to the energy generating body and the time a bubble is generated on the energy generating body. In addition, at an earlier time than maximum meniscus protrusion the ink is still moving in the direction toward discharge, thus contributing to a larger droplet size because the ink has momentum toward the discharge opening.

On the other hand, if the pulse P2 is supplied at the time of about t=40 microseconds, the difference of the volumes of discharged ink droplets becomes a negative value, in contrast with the foregoing description. This is believed to be because the meniscus, which first became convex as discussed above, will have returned by surface tension of the ink to become more concave than in the steady state due to the kinetic energy of the ink. Another reason that the meniscus retracts further than in the steady state is the collapse of the bubbles in the ink paths communicated with the discharge openings Nos. 1 to 4.

Solutions have been proposed to this problem of uneven droplet size. One is disclosed in U.S. Pat. No. 4,578,687, in which an ink jet head has a communication portion between ink in the ink jet head and the atmosphere. The pressure fluctuations in the common ink chamber of the ink jet head are released through the communication portion at the time of ink discharge to prevent mutual interference of the ink paths with each other. However, this approach still has some problems. One of them is the possible introduction of extraneous matter into the ink jet head through the communication portion. Another is the deterioration of discharge characteristics, even leading to the inability to discharge ink entirely, due to the change of physical properties of the ink due to evaporation of ink solvent through the communication portion. In order to prevent these problems, it is necessary to use techniques that make the apparatus prohibitively expensive.

In Japanese Patent Laid-Open (Kokai) No. 1-285356, an ink jet head has gas storing means to absorb the shock of ink pressure fluctuations in the common ink chamber. However, it is difficult to retain the proper amount of gas in the common ink chamber.

Another proposition is to make the distance d between the rear edges of the separation walls for the ink paths and the rear wall of the common ink chamber large enough to prevent mutual interference of the ink paths with each other. For example, if that distance d is larger than 6 mm, mutual interference can be minimized. However, this method is counter to the tendency and demand for a compact ink jet head and a compact ink jet apparatus. In addition, such an increase in size of the ink jet head causes a large cost increase for manufacturing the ink jet head, because a wafer of silicon, which is often used as the base member of the ink jet head, is relatively expensive.

Another proposal would involve simultaneously discharging ink from all of the discharge openings needed for recording. However, that requires a large capacity power source for driving the energy generating members, and the size and the cost of the ink jet apparatus increases accordingly.

The pulses could be supplied for discharging subsequent ink droplets after passage of enough time for the meniscuses of the previously used discharge openings to reach a steady state. However, that is counter to the tendency and demand for rapid recording. Moreover, if a droplet already deposited on the recording medium begins to dry before an adjacent droplet is deposited, recording quality can be noticeably affected.

SUMMARY OF THE INVENTION

The present invention has been developed in consideration of the above situation. It is an object of the present invention to provide an improved ink jet head, an improved ink jet apparatus and an improved driving method for an ink jet head, each of which can overcome the problems described above.

It is another object of the present invention to provide an ink jet head, an ink jet apparatus and a driving method for an ink jet head, each of which can carry out recording of high quality at high speed.

It is still another object of the present invention to provide an ink jet head, an ink jet apparatus and a driving method for an ink jet head, each of which can provide a compact device at small cost.

It is further another object of the present invention to provide an ink jet head, an ink jet apparatus and a driving method for an ink jet head, each of which can suppress interference caused by the change of ink pressure or the movement of ink in an ink passage due to discharging ink.

According to one aspect of the present invention, a liquid jet head comprises plural ink paths, each having a discharge opening for enabling discharge of ink when energy is applied to ink in a corresponding ink path, and a common ink chamber communicating with an end of each ink path for supplying ink in the common ink chamber to the discharge openings, wherein the discharge openings are disposed in plural discharge opening groups, the groups being consecutively driven by simultaneously applying energy to ink in the ink paths corresponding to selected discharge openings in each group, the ends of ink paths corresponding to the discharge openings in each discharge opening group are disposed in the common ink chamber in ink path groups consecutively arranged in accordance with the driving order of the discharge opening groups, and each ink path includes a portion proximate to the end thereof directed away from the next consecutively arranged the ink path group.

According to another aspect of the invention, an ink jet apparatus includes such an ink jet head and driving means for consecutively driving the discharge opening groups.

According to yet another aspect of the present invention, a driving method for an ink jet head, including plural ink paths, each having a discharge opening for enabling discharge of ink when energy is applied to ink in a corresponding ink path, and a common ink chamber communicating with an end of each ink path for supplying ink in the common ink chamber to the discharge openings, wherein the discharge openings are disposed in plural discharge opening groups, the groups being consecutively driven by simultaneously applying energy to ink in the ink paths corresponding to selected discharge openings in each group, the ends of ink paths corresponding to the discharge openings in each discharge opening group are disposed in the common ink chamber in ink path groups consecutively arranged in accordance with the driving order of the discharge opening groups, and each ink path includes a portion proximate to the end thereof directed away from the next consecutively arranged ink path group, comprises the steps of driving each discharge opening group by discharging ink from selected discharge openings in each discharge opening group by applying energy to ink in the ink paths corresponding to the selected discharge openings, and driving the discharge opening groups consecutively.

Other objects, features and advantages of the present invention will become apparent from the following detailed description of the preferred embodiments of the present invention and the accompanying drawings.

DESCRIPTION OF THE PREFERRED EMBODIMENTS

Figure 1A:
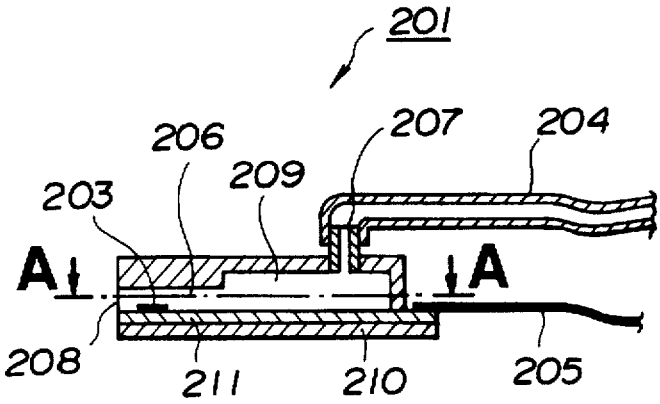
FIG. 1A is a schematic cross sectional view showing an ink discharging portion of a conventional ink jet recording head.

Referring now to the drawings, preferred embodiments of the present invention will be described in detail.

Figure 5A:
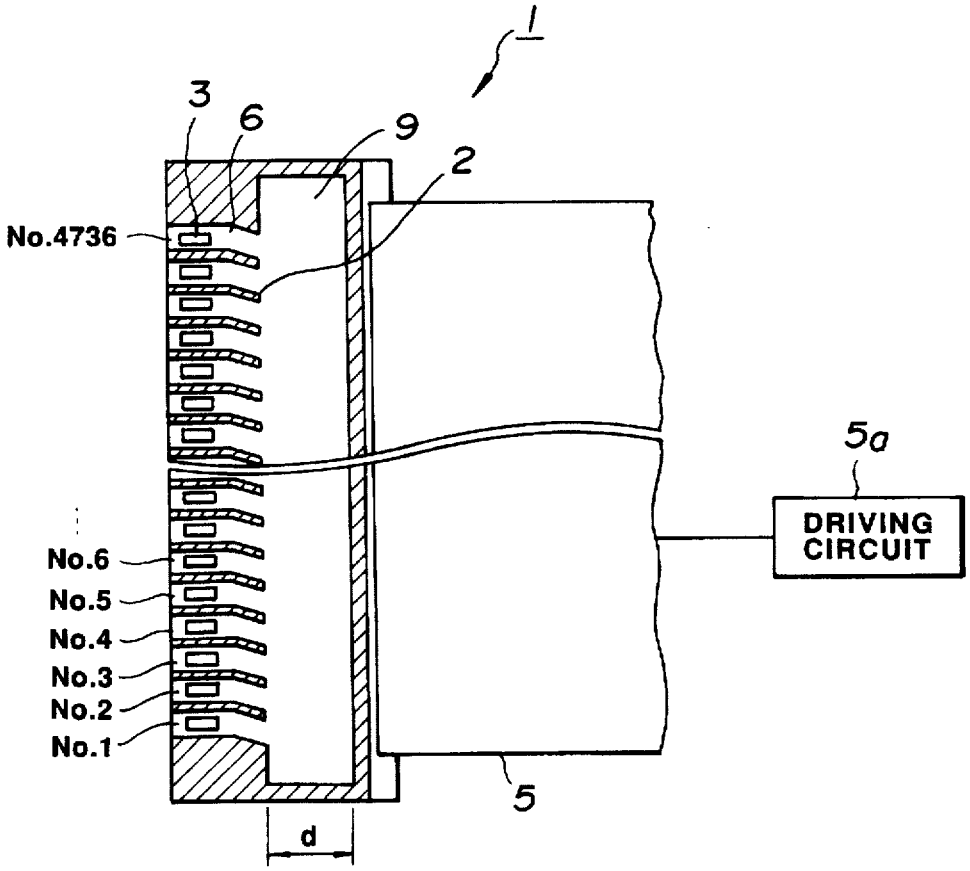
FIG. 5A is a schematic cross sectional view showing an ink discharging portion of an ink jet recording head in respect to an embodiment of the present invention.
Figure 5B:
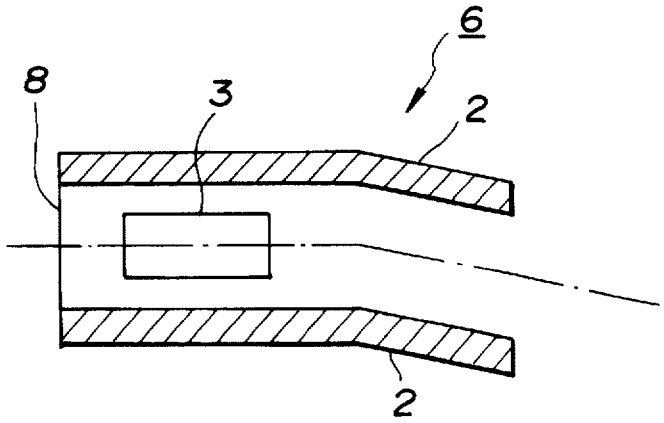
FIG. 5B is a schematic enlarged partial cross sectional view showing one ink path of the ink jet head illustrated in FIG. 5A.

FIG. 5A is a schematic cross sectional view showing an ink discharging portion of an ink jet recording head 1 in respect to an embodiment of the present invention. FIG. 5B is a schematic enlarged partial cross sectional view showing one ink path of the ink jet head illustrated in FIG. 5A. As illustrated in FIG. 5A, a plurality of discharge openings 8 are provided at a pitch of 63.5 microns in a substantially vertical direction on a surface of a recording head 1, which is positioned opposed to a recording medium such as recording paper (not shown in FIGS. 5A and 5B) at a certain distance (for example, about 0.5 to 2.0 mm) from the surface. The discharge openings are flush with the surface of the ink jet head so that an ink meniscus forms at each discharge opening. Other arrangements are possible in the present invention. The discharge openings 8 are designated No. 1 to No. 4736. A heat generating portion 3 of an electro-thermal converting body for generating thermal energy is provided on a wall of each ink path 6, which is defined by separation walls 2 and communicates between a common ink chamber 9 and each discharge opening 8. The electro-thermal converting body applies energy to ink in the ink path to discharge ink from the corresponding discharge opening.

The ink jet recording head 1 is carried on a carriage (not shown in FIGS. 5A and 5B) so that the discharge openings 8 are disposed in a line transverse to the direction of the movement of the carriage (the main scanning direction). Ink is discharged as a droplet from a selected discharge opening 8 of the recording head 1 by actuating the corresponding electro-thermal converting body according to a discharge signal provided from a driving circuit 5*a* of the apparatus through a flexible cable 5 to generate a bubble by film boiling of the ink in the corresponding ink path 6.

Figure 2:
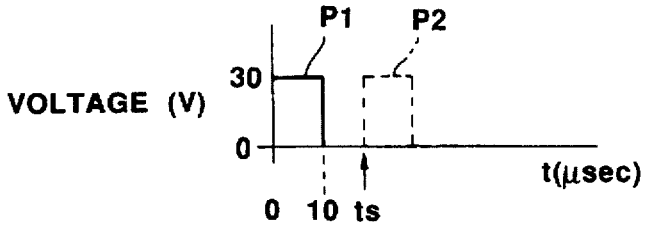
FIG. 2 is a graph showing the timing of conventional pulses supplied to energy generating bodies of the ink jet head shown in FIGS. 1A and 1B.
Figure 3:
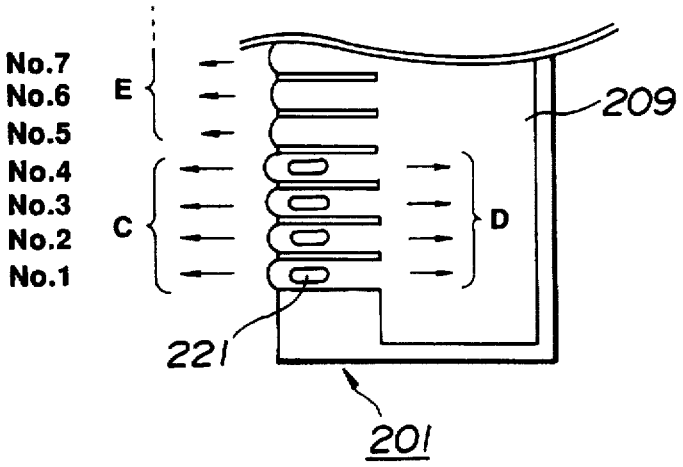
FIG. 3 is a schematic partial sectional view showing a portion of the ink jet head illustrated in FIG. 1B.
Figure 4:
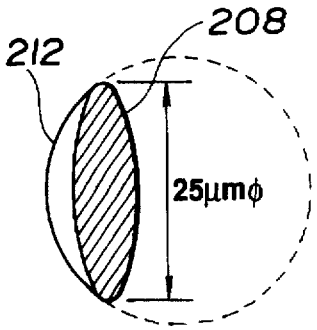
FIG. 4 is a schematical view for approximate calculation of the protrusion of the meniscus.

The driving circuit 5*a* is conventional in construction and operation, examples being shown in U.S. Pat. No. 5,173,717. It provides enabling pulses (like P1 and P2 in FIG. 2) to circuitry that allows the electro-thermal converting bodies of consecutive groups of discharge openings to be actuated. Such actuation is typically carried out simultaneously for selected discharge openings in a group. That is, the discharge openings that are to contribute to recording are selected by simultaneously applying recording signals to selected corresponding electro-thermal converting bodies. As noted, this division driving circuitry is conventional, and its details will be readily apparent to those skilled in this art. (It should be understood that "simultaneous" includes substantially simultaneous as well as exactly simultaneous.)

Figure 1B:
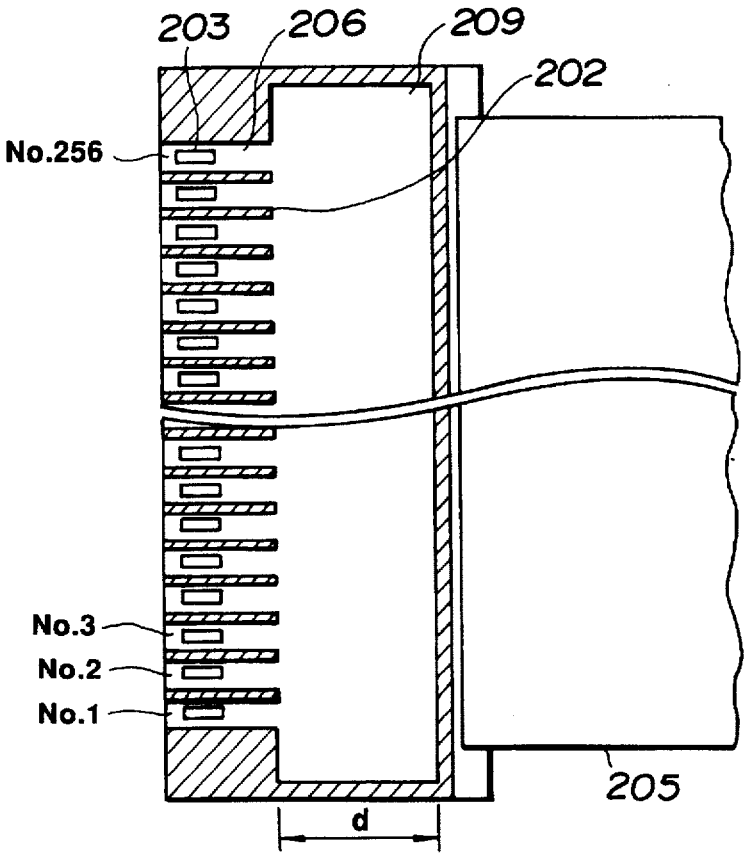
FIG. 1B is a schematic cross sectional view taken on line A—A of FIG. 1A.

One important structural difference between the ink jet recording head 1 of this embodiment illustrated in FIGS. 5A and 5B, and the ink jet recording head 201 of the related background art illustrated in FIGS. 1A and 1B, is that the center lines of the respective ink paths have a particular directional characteristic, here center lines in the rear of the respective ink paths that are directed toward ink path No. 1. In other words, the structure of the portion of each ink path at the end thereof in the chamber 9 is different from the corresponding portion in prior art ink jet heads.

The recording head 1 of this embodiment has 4,736 ink paths 6, respective pitches of which are 63.5 microns, and carries out recording at a recording density of 400 DPI (dots per inch) at a recording width of approximately 30 cm. This recording width is large enough for the recording head to be used as a full-line type of recording head having plural discharge openings extending over the entire recording area of a recording medium. In this embodiment, the distance d between the rear edges of the separation walls 2 for ink paths and the rear wall of the common ink chamber 9 is 2 mm, which is generally less than in the related background art.

Figure 6A:
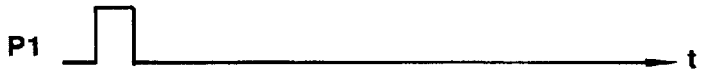
FIGS. 6A to 6C are graphs for explaining the divisional driving method of the ink jet head.
Figure 6B:
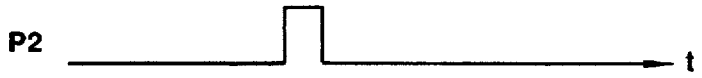
Figure 6C:
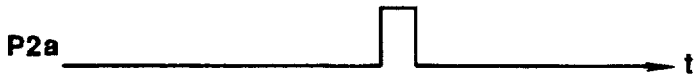

FIGS. 6A to 6C are graphs for explaining how divisionally driving this ink jet head improves over the prior art. The 4,736 ink paths 6 of the ink jet head 1 are divided into 74 groups of 64 ink paths to record one line. FIG. 6A illustrates the timing of the first pulse P1 for simultaneously enabling ink paths Nos. 1 to 64 to be driven selectively in accordance with recording signals. FIG. 6B illustrates the timing of the second pulse P2 of this embodiment for simultaneously enabling ink paths Nos. 65 to 128 to be driven. Additional pulses P3 to P74 are provided until driving of all 4,736 ink paths is enabled, thus providing for recording of one line. As a comparison, FIG. 6C illustrates the timing of the second pulse P2*a* of the related background art (FIG. 2), thus showing the longer driving timing for ink paths Nos. 65 to 128 in such art.

Figure 6D:
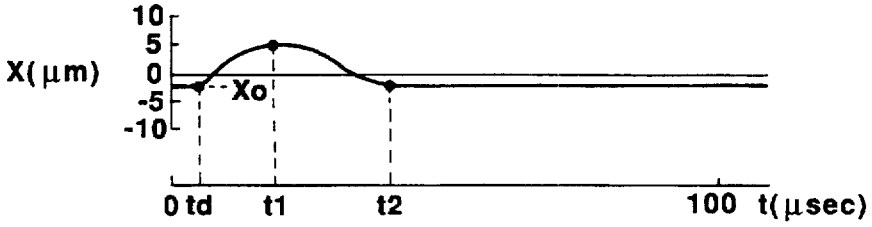
FIGS. 6D and 6E are graphs showing changing aspects of ink projection lengths of the meniscus at the discharge opening for explaining the difference between an embodiment of the invention and a comparative example.
Figure 6E:
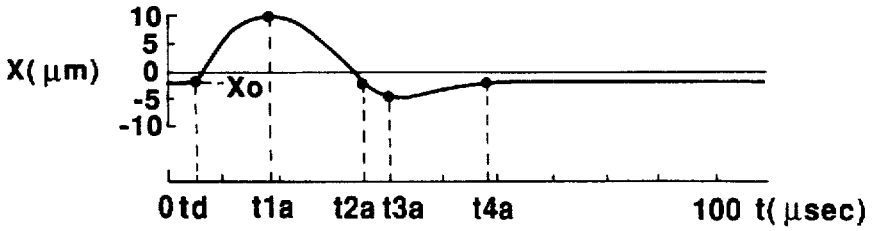

FIGS. 6D and 6E are graphs showing the changes in the meniscuses at discharge openings for an embodiment of the present invention and for a comparative example. In FIGS. 6D and 6E, a plus (+) value of the length X means a convex meniscus, and a minus (−) value of length X means a concave meniscus. The length X is −2 microns when the meniscus is in a steady state. (The meniscus at the discharge opening communicated with the more remote ink path No. 66 will move less than the meniscus movement depicted in FIGS. 6D and 6E for the discharge opening communicated with the ink path No. 65.)

FIG. 6D illustrates, in respect to this embodiment, changes in the ink projection length X (in microns) of the meniscus at the discharge opening of ink path No. 65 after the pulse P1 has been supplied for ink paths Nos. 1 to 64. When the delay time td has passed after the pulse P1 was supplied for the ink paths Nos. 1 to 64, that is, at the time of t=td in FIG. 6D, the ink projection length X begins to change from the steady state XO. At the time of t=t1, the ink projection length becomes the maximum value. Then at the time of t=t2, the ink projection length X becomes −2 microns, which is identical with that in the steady state. After that, the ink projection length X remains the value in the steady state.

FIG. 6E illustrates, in respect to the related background art, the changes in the ink projection length X (microns) of the meniscus at the discharge opening of ink path No. 65 after the pulse P1 has been supplied for ink paths Nos. 1 to 64. When the delay time td has passed after the pulse PI was supplied for the ink paths No. 1 to 64, that is, at the time of t=td in FIG. 6E, the ink projection length X begins to change from the steady state X0. At the time of t=t1a, the ink projection length becomes the maximum value. Then at the time of t=t2a, the ink projection length X becomes −2 microns, which is identical with that in the steady state. Next, at the time of t=t3a, the ink projection length X becomes the minimum value. Subsequently, at the time of t=t4a, the ink projection length becomes −2 microns again, which is identical with that in the steady state. After that, the ink projection length X remains at the steady state value.

In the related background art, if the second pulse P2 is supplied for the ink path No. 65 at the approximate time of t=t1a after pulse P1 is supplied for ink paths Nos. 1 to 64, the volume of the ink droplet enabled by the pulse P2 to be discharged from the discharge opening of the ink path No. 65 is more than when the second pulse P2 is supplied for the ink path No. 65 without supply of the pulse P1. On the other hand, if the second pulse P2 is supplied for the ink path No. 65 at the approximate time of t=t3a after the pulse PI is supplied for the ink paths Nos. 1 to 64, the volume of the ink droplet enabled by the pulse P2 to be discharged from the discharge opening communicated with the ink path No. 65 is less than when the second pulse P2 is supplied for the ink path No. 65 without supply of the pulse PI. Therefore, if the second pulse P2 is supplied before the time of t=t4a after the pulse P1 is supplied, it will be difficult to control the volume of the ink droplet enabled to be discharged by the pulse P2 so that it is constant regardless of the presence or absence of the pulse P1. Thus, influence by mutual interference occurred in the ink passages of the ink jet head of the related background art.

On the other hand, in this embodiment, the fluctuation of the meniscus is small as illustrated in FIG. 6D. Accordingly, if the second pulse P2 is supplied for ink path No. 65 at the time of t=t2 after the pulse P1 is supplied for ink paths Nos. 1 to 64, the volume of the ink droplet enabled by the pulse P2 to be discharged from the discharge opening of the ink path No. 65 does not change regardless of the presence or absence of the pulses Pi. In other words, influence by mutual interference does not occur in the ink passages of the ink jet head in this embodiment, as long as the pulse P2 is provided at t=t2 or later. The reason is believed to be that pressure change in ink in the ink path spreads in the unrelated direction to the subsequent discharging by the structure of the ink passage.

To obtain this structure, the portion of each ink path proximate to the end in the common ink chamber is directed away from the end of the ink paths corresponding to the discharge opening group to be driven next. Preferably, the respective ink paths have nonlinear center lines, and in this embodiment each ink path includes two straight portions disposed at an angle to each other.

Therefore, t2-td=34 microseconds are sufficient for the interval between pulses at the divisional driving in this embodiment as compared with t4a-td=54 microseconds in the related background art. Consequently, recording speed can be increased by approximately 37% with this embodiment. The more the number of the discharge openings of the ink jet head and/or the number of the discharge openings for simultaneously discharging ink, the larger the effects mentioned above. Particularly, the effects mentioned above become conspicuous if this invention is applied to an ink jet head with at least 64 ink paths therein (which is not meant to restrict the present invention to any particular number). The present invention includes any type of ink jet head for the use of the divisional driving with at least two discharge openings and with each discharge opening group having at least one discharge opening.

Figure 7A:
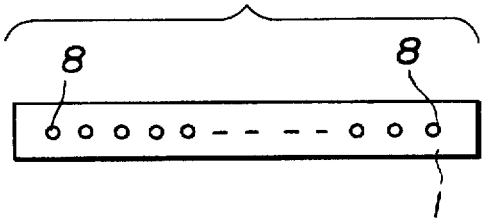
FIG. 7A is a schematic plan view showing the arrangement of discharge openings of the ink jet head in respect to the embodiment of the present invention.
Figure 7B:
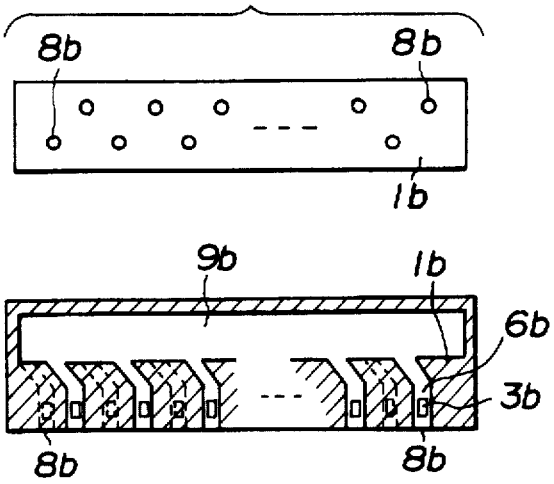
FIG. 7B is a schematic plan view and a schematic sectional view showing the arrangement of discharge openings and ink paths of an ink jet head in respect to another embodiment of the present invention.

FIG. 7A is a schematic plan view showing the arrangement of discharge openings of the ink jet head of the embodiment described above. In FIG. 7A discharge openings 8 are arranged in line. FIG. 7B shows the arrangement of discharge openings 8*b* and ink paths 6*b* of an ink jet head 1*b* of another embodiment. In this embodiment, the discharge openings 8*b* are arranged in two layers, the discharge openings in both of which communicate with a common ink chamber 9*b*. The discharge openings 8*b* in each layer are also divided into groups from the left to the right in FIG. 7B. Each group has a number of ink paths with heat generating portions 3*b* of electro-thermal converting bodies. Enabling pulses are supplied to consecutive groups of discharge openings in one layer, from left to right in FIG. 7B, and then to consecutive groups in the other layer in the same fashion. Effects similar to those of the embodiment mentioned above can be obtained by using this ink jet head with such a division driving technique.

Figure 7C:
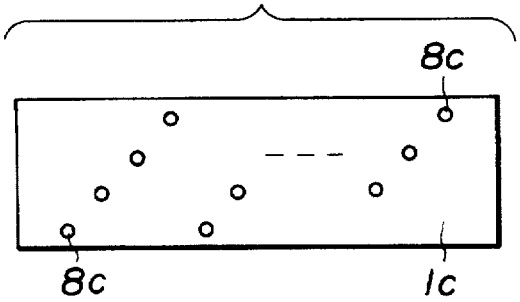
FIG. 7C is a schematic plan view showing the arrangement of discharge openings of an ink jet head in respect to another embodiment of the present invention.

FIG. 7C is a schematic plan view showing the arrangement of discharge openings 8C of an ink jet head 1 of another embodiment. In this embodiment, the discharge openings 8 are divided into four layers, of which discharge openings are communicated with a common ink chamber. Divisional driving is carried out as in the embodiment shown in FIG. 7B. Effects similar to those of the embodiment mentioned above can be obtained by making use of this ink jet head.

Figure 8:
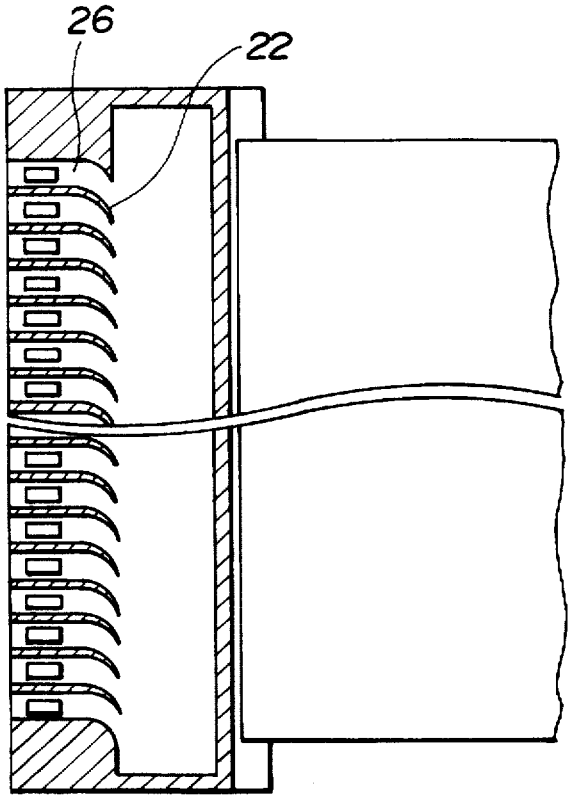
FIG. 8 is a schematic sectional view showing a portion of an ink jet head in respect to another embodiment of the present invention.

FIG. 8 is a schematic sectional view showing a portion of an ink jet head of another embodiment. The separation walls 22 for the ink paths 26 are curvilinear at the portion where they communicate with the common chamber, as shown in FIG. 8 in this embodiment, as compared with the above-mentioned embodiment in which each ink path is formed of two straight portions at as shown in FIG. 5A. Effects similar to those of the embodiment mentioned above can be obtained in this embodiment.

In addition, electro-mechanical converting bodies, for example, piezoelectric elements, can be used as energy generating bodies for generating energy utilized to discharge ink instead of electro-thermal converting bodies in the embodiment mentioned above. Effects similar to those of the embodiment mentioned above can be obtained with such structure.

As mentioned above, it is generally known that the deterioration of recording quality due to deterioration of discharge characteristics by mutual interference can be recognized visually if the difference of the volumes of ink droplets deposited adjacent to each other on the recording medium exceeds approximately 10% (which value is intended in no way to restrict the scope of the present invention). That is, the higher the required level of recording quality, the smaller is the permitted difference in the volumes of adjacently deposited ink droplets.

Figure 9:
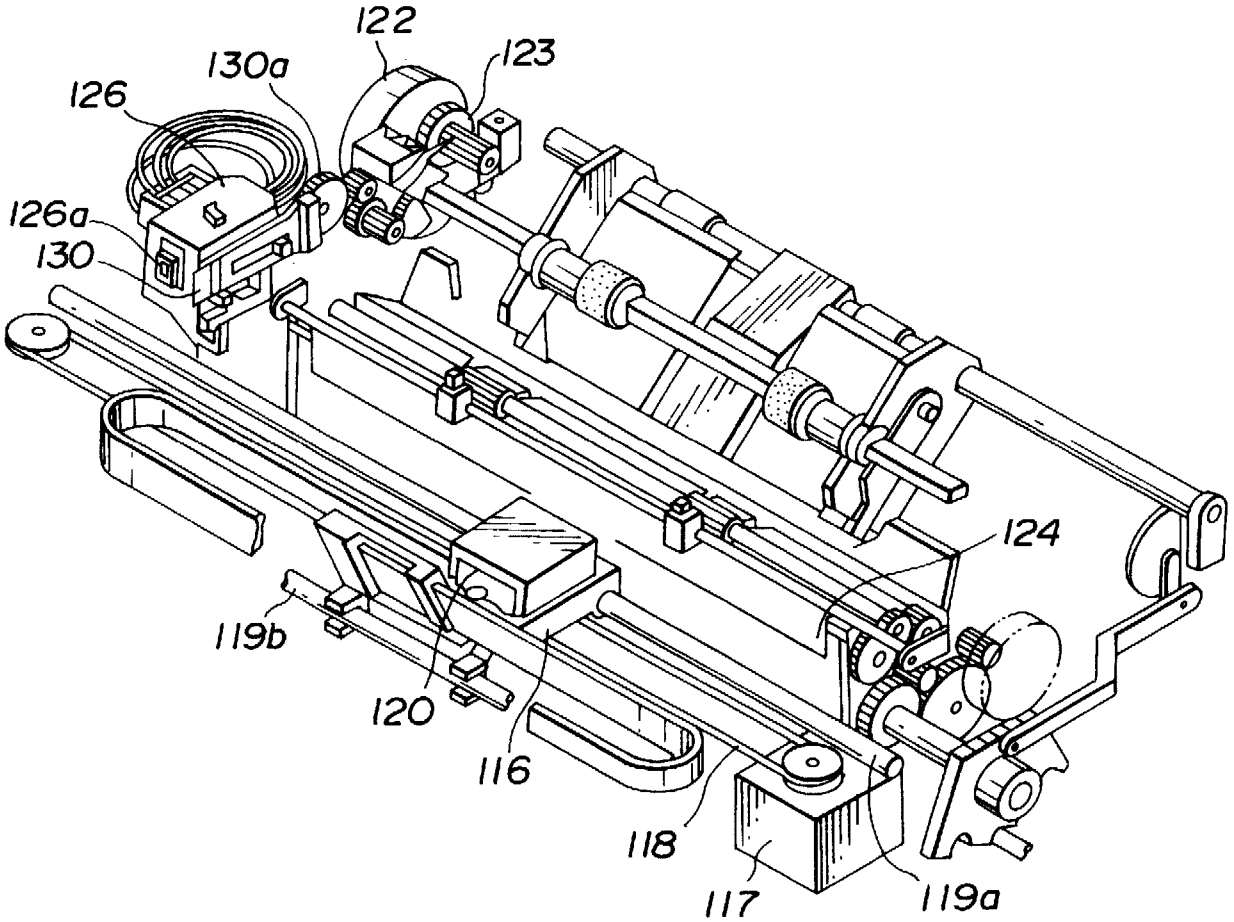
FIG. 9 is a schematic perspective view showing a main portion of an ink jet recording apparatus for explaining an embodiment of the present invention.

FIG. 9 is a schematic perspective view showing a main portion of an ink jet recording apparatus for explaining an embodiment of the present invention. As illustrated in FIG. 9, an ink jet cartridge 120 including the ink jet head mentioned above and an ink storage container is carried on a carriage 116, which is supported along guide shafts 119*a* and 119*b* to move reciprocally. A recording medium such as paper, a plastic sheet or a cloth sheet is conveyed in a sub-scanning direction transverse to the main scanning movement of the carriage 116 through a recording area, which is in a range of the movement of the carriage 116. In the recording area a predetermined gap (a flying distance of a droplet, for example 0.8 mm) is provided between a front surface (a surface with discharge openings) of the ink jet cartridge 120 and a recording surface of the recording medium. The discharge openings are situated in a line substantially transverse to the main scanning direction of the movement of the carriage 116.

The movement of the carriage 116 is carried out through a driving belt 118 by driving a carriage driving motor 117. Conveyance of the recording medium is carried out on a platen 124 by conveying rollers. The recording of one line on the recording medium is carried out by discharging ink from selected discharge openings in response to image signals in synchronism with the movement (main scanning) of the ink jet cartridge 120 while the recording medium, which is disposed in the recording area, is stationary. Timings of the discharge of ink are controlled by output from a driving circuit. After the recording of one line, the recording medium is moved one line in the sub-scanning direction. Then the recording of the next line is carried out as the ink jet cartridge 120 moves main scanning direction. The main scanning and sub-scanning are repeated alternately and desired images are printed on the recording medium.

A recovery apparatus 126 for maintaining and recovering a discharge capability of the recording head is generally situated at a predetermined position, for example a home position of the carriage 116, which is in the range of the movement of the carriage 116 but out of the recording area. This recovery apparatus has a cap member **126*a* for covering and closing tightly discharge openings of the recording head from the atmosphere, a cleaning wiper member 130 for wiping extraneous matter like viscous ink off of the surface of the discharge openings of the recording head, and a suction pump (not illustrated in FIG. 9) connected to the cap member 126*a* for carrying out suction recovery by exerting a suction force on the discharge openings when they are covered by the cap member 126*a***.

The cap member **126*a* is generally made of a non-gas-permeable elastic material and prevents clogging of the discharge openings by extraneous matter such as viscous ink or dust. For example, in case recording is not carried out for a certain time in an ink jet recording apparatus, the cap member 126*a* is moved forward by a driving motor 122 through a transmission mechanism 123** to cap the recording head.

The cleaning wiper member 130 is generally made of a plate-shaped elastic body such as urethane rubber and can be moved back and forth with a wiper holder **130*a* by the driving motor 122 through the transmission mechanism 123. In case wiping of the surface of the discharge openings is necessary, the cleaning wiper member 130 is moved forward by the driving motor 122 and the surface of the discharge openings makes contact with the cleaning wiper member 130 by utilizing the movement of the carriage 116**.

The present invention is particularly useful in an ink jet recording head and an ink jet recording apparatus of the type which discharges ink by making use of thermal energy. This is because high density of picture elements and high resolution of recording are possible.

The typical structure and the operational principle of such an apparatus are disclosed in U.S. Pat. Nos. 4,723,129 and 4,740,796. The principle is applicable to a so-called on-demand type recording system and a continuous type recording system. Particularly, however, it is suitable for the on-demand type because the principle is such that a least one driving signal is applied to an electrothermal transducer disposed on a liquid (ink) retaining sheet or liquid passage, the driving signal being sufficient to provide such a quick temperature rise beyond the nucleate boiling point, by which the thermal energy is provided by the electrothermal transducer to produce film boiling on the heating portion of the recording head, that a bubble can be formed in the liquid (ink) corresponding to each of the driving signals. By the development and collapse of the bubble, the liquid (ink) is ejected through an ejection outlet to produce at least one droplet. The driving signal is preferably in the form of a pulse, because the development and collapse of the bubble can be effected instantaneously, and therefore, the liquid (ink) is ejected with quick response. The driving signal in the form of the pulse is preferably such as that disclosed in U.S. Pat. Nos. 4,463,359 and 4,345,262. In addition, the temperature increasing rate of the heating surface is preferably such as disclosed in U.S. Pat. No. 4,313,124.

The structure of the recording head may be as shown in U.S. Pat. Nos. 4,558,333 and 4,459,600 wherein the heating portion is disposed at a bent portion in addition to the structure of the combination of the ejection outlet, liquid passage and the electrothermal transducer as disclosed in the above-mentioned patents. In addition, the present invention is applicable to the structure disclosed in Japanese Patent Laid-Open (Kokai) No. 59-123670 wherein a common slit is used as the ejection outlet for plural electrothermal transducers. This is because the present invention is effective to perform the recording operation with certainty and at high efficiency irrespective of the type of the recording head.

The present invention is effectively applicable to a so-called full-line type recording head having a length corresponding to the maximum recording width. Such a recording head may comprise a single recording head or plural recording heads combined to cover the entire width.

In addition, the present invention is applicable to a serial type recording head wherein the recording head is fixed on the main assembly, to a replaceable chip type recording head which is connected electrically with the main apparatus and can be supplied with the ink by being mounted in the main assembly, or to a cartridge type recording head having an integral ink container.

The provision of recovery means and auxiliary means for preliminary operation are preferable, because they can further stabilize the effect of the present invention. As for such means, there are capping means for the recording head, cleaning means therefor, pressing or suction means, preliminary heating means by the ejection electrothermal transducer or by a combination of the ejection electrothermal transducer and an additional heating element and means for preliminary ejection not for the recording operation, which can stabilize the recording operation.

As for the kinds of recording head useful with the present invention, it may be a single head corresponding to a single color ink, or may be plural heads corresponding to a plurality of ink materials having different recording colors or densities. The present invention is effectively applicable to an apparatus having at least one of a monochromatic mode for recording mainly with black ink material and a multicolor mode for recording with a mixture of the colors and may be an integrally formed recording unit or a combination of plural recording heads.

Furthermore, in the foregoing embodiments, the ink material has been liquid. It may be, however, an ink material that solidifies at or below room temperature and liquefies at room temperature. Since in the ink jet recording system the ink is controlled within a temperature range not lower than 30° C. and not higher that 70° C. to stabilize the viscosity of the ink to ensure stabilized ejection, in usual recording apparatuses of this type, the ink is such that it is liquid within the temperature range when the recording signal is applied. The most effective system for the ink materials described above is the film boiling system.

The ink jet recording apparatus may be used as an output terminal of an information processing apparatus such as computer or the like, a copying apparatus combined with an image reader or the like, or a facsimile machine having information sending and receiving functions.

It should be understood that the foregoing explanation is directed to preferred embodiments of the invention and is not intended to suggest that alterations to such embodiments are outside the scope of the present invention, which is defined by the claims appended hereto.

What is claimed is:

1. An ink jet head comprising:

a plurality of discharge openings for discharging ink;

a plurality of discharging energy generating means for applying energy to discharge ink;

a plurality of ink paths communicating with said discharge openings for enabling discharge of ink; and a common ink chamber communicating with an end of each of said ink paths for supplying ink in said common ink chamber to said discharge openings, wherein said discharge openings are disposed in a plurality of discharge opening groups, said groups being consecutively driven by simultaneously applying energy to ink in those of said ink paths corresponding to selected said discharge openings in each said group, wherein said end of each of said ink paths corresponding to said discharge openings in each said discharge opening group is disposed in said common ink chamber in ink path groups consecutively arranged in accordance with a driving order of said discharge opening groups, and wherein a wall opposed to each of said ink paths disposed in said common ink chamber is intersected on an extension of a center line of said end of each said ink path at an angle less than 90° on a next consecutively arranged ink path side.

2. An ink jet head according to claim 1, wherein each said ink path has a nonlinear center line.

3. An ink jet head according to claim 1 or 2, wherein each said ink path includes two straight sections disposed at an angle to each other.

4. An ink jet head according to claim 1 or 2, wherein each said ink path is curvilinear.

5. An ink jet head according to claim 1, wherein said plural ink paths are at least 64 in number.

6. An ink jet head according to claim 1, wherein said energy generating means is an electro-thermal converting body for generating thermal energy.

7. An ink jet head according to claim 6, wherein ink is discharged by growth and contraction of a bubble generated in the ink by film boiling caused by thermal energy from said electro-thermal converting body.

8. An ink jet head according to claim 1, wherein said energy generating means is an electro-mechanical converting body for generating kinetic energy.

9. An ink jet head according to claim 1, wherein said discharge openings are disposed in an array for extending over the entire recording area of a recording medium.

10. An ink jet head according to claim 1, wherein said discharge openings are flush with a surface of said ink jet head to provide at each said discharge opening a meniscus formed by ink in said corresponding ink path.

11. An ink jet head according to claim 1, wherein said ink paths and corresponding discharge openings are disposed in plural layers.

12. An ink jet apparatus comprising:

an ink jet head including a plurality of discharge openings for discharging ink;

a plurality of discharging energy generating means for applying energy to discharge ink;

a plurality of ink paths communicating with said discharge openings for enabling discharge of ink; and a common ink chamber communicating with an end of each of said ink paths for supplying ink in said common ink chamber to said discharge openings, wherein said discharge openings are disposed in a plurality of discharge opening groups, said groups being consecutively driven by simultaneously applying energy to ink in those of said ink paths corresponding to selected said discharge openings in each said group, wherein said end of each of said ink paths corresponding to said discharge openings in each said discharge opening group is disposed in said common ink chamber in ink path groups consecutively arranged in accordance with a driving order of said discharge opening groups, and wherein a wall opposed to each of said ink paths disposed in said common ink chamber is intersected on an extension of a center line of said end of each of said ink paths at an angle less than 90° on as next consecutively arranged ink path side; and driving means for consecutively driving said discharge opening groups.

13. A driving method for an ink jet head including a plurality of discharge openings for discharging ink, a plurality of discharging energy generating means for applying energy to discharge ink, a plurality of ink paths communicating with said discharge openings for enabling discharge of ink, and a common ink chamber communicating with an end of each of said ink paths for supplying ink in said common ink chamber to said discharge openings, wherein said discharge openings are disposed in a plurality of discharge opening groups, said groups being consecutively driven by applying energy to ink in those of said ink paths corresponding to selected said discharge openings in each said group, wherein said end of each of said ink paths corresponding to said discharge openings in each said discharge opening group is disposed in said common ink chamber in ink path groups consecutively arranged in accordance with a driving order of said discharge openings groups, and wherein a wall opposed to each of said ink paths disposed in said common ink chamber is intersected on an extension of a center line of said end of each of said ink paths at an angle less than 90° on a next consecutively arranged ink path side, the method comprising the steps of:

driving each said discharge opening group for discharging ink from selected said discharge openings in each said discharge opening group by applying energy to ink in said ink paths corresponding to said selected discharge openings; and driving said discharge opening groups consecutively.

14. An ink jet head comprising:

a plurality of discharge openings for discharging an ink;

a plurality of ink paths communicating with said discharge openings for enabling discharging of the ink, each said ink path having an end, and each said end having a center line;

a plurality of discharging energy generating means disposed in said ink paths for applying energy to discharge the ink; and a common ink chamber communicating with the ends of each of said ink paths for supplying the ink from said common ink chamber to said ink paths, the common ink chamber having a wall opposed to the ends of said ink paths, wherein said plurality of discharging energy generating means are driven consecutively, and wherein the wall of said common ink chamber opposed to said end of each said ink path disposed therein is intersected on an extension of the center line of said end of each said ink path at an angle less than 900 on a next driving discharging energy generating means side.

15. An ink jet apparatus comprising:

an ink jet head including a plurality of discharge openings for discharging an ink, a plurality of ink paths communicating with said discharge openings for enabling discharging of the ink, each said ink path having an end, and each said end having a center line, a plurality of discharging energy generating means disposed in said ink paths for applying energy to discharge the ink, and a common ink chamber communicating with the ends of each of said ink paths for supplying the ink from said common ink chamber to said ink paths, the common ink chamber having a wall opposed to the ends of said ink paths, wherein said plurality of discharging energy generating means are driven consecutively, and wherein the wall of said common ink chamber opposed to said end of each said ink path disposed therein is intersected on an extension of the center line of said end of each said ink path at an angle less than 90° on a next driving discharging energy generating means side; and driving means for consecutively driving said discharging energy generating means.

* * * * *

UNITED STATES PATENT AND TRADEMARK OFFICE

CERTIFICATE OF CORRECTION

PATENT NO. : 5,745,129

DATED : April 28, 1998

INVENTOR(S) : JIRO MORIYAMA, ET AL.

It is certified that error appears in the above-identified patent and that said Letters Patent is hereby corrected as shown below:

On the title page:

AT [56] REFERENCES CITED

FOREIGN PATENT DOCUMENTS

"1285356 11/1989 Japan" should read
--1-285356 11/1989 Japan--.

COLUMN 3

Line 1, "ink" (first occurrence) should be deleted;
Line 43, "micro-seconds" should read --microseconds--; and
Line 63, "parallel-piped" should read --parallelepiped--.

COLUMN 6

Line 39, "schematical" should read --schematic--.

COLUMN 8

Line 43, "XO" should read --X0--.

COLUMN 9

Line 11, "PI" should read --P1--; and
Line 26, "Pi" should read --P1--.

COLUMN 11

Line 8, "moves" should read --moves in the--; and
Line 53, "a" should read --at--.

UNITED STATES PATENT AND TRADEMARK OFFICE

CERTIFICATE OF CORRECTION

PATENT NO. : 5,745,129

DATED : April 28, 1998

INVENTOR(S) : JIRO MORIYAMA, ET AL.

It is certified that error appears in the above-identified patent and that said Letters Patent is hereby corrected as shown below:

COLUMN 13

Line 26, "each" should read --each of--; and
Line 27, "path" should read --paths--.

COLUMN 14

Line 14, "as" should read --a--;
Line 34, "openings" should read --opening--; and
Line 66, "900" should read --90°--.

Signed and Sealed this

Tenth Day of November 1998

*Attest:*

*Attesting Officer*

BRUCE LEHMAN

*Commissioner of Patents and Trademarks*